US005314363A

United States Patent [19]

Murray

[11] Patent Number: 5,314,363

[45] Date of Patent: May 24, 1994

[54] AUTOMATED SYSTEM AND METHOD FOR ASSEMBLING IMAGE INTENSIFIER TUBES

[75] Inventor: Timothy G. Murray, Hardy, Va.

[73] Assignee: ITT Corporation, New York, N.Y.

[21] Appl. No.: 73,746

[22] Filed: Jun. 8, 1993

[51] Int. Cl.[5] ..... H01J 9/12

[52] U.S. Cl. ..... 445/14; 445/29; 445/40; 445/42; 445/67

[58] Field of Search ..... 445/10, 13, 14, 16, 445/40, 42, 56, 29, 32, 71, 67, 44

[56] References Cited

U.S. PATENT DOCUMENTS

| | | | |
|---|---|---|---|
| 1,927,792 | 9/1933 | Charlton | 445/13 |
| 2,128,582 | 8/1938 | Gardner | 445/13 |
| 2,277,691 | 3/1942 | Curwen et al. | 445/56 |
| 2,812,228 | 11/1957 | Gilmore et al. | 445/16 |
| 4,799,911 | 1/1989 | Relder | 445/14 |

*Primary Examiner*—Kenneth J. Ramsey
*Assistant Examiner*—Jeffrey T. Knapp
*Attorney, Agent, or Firm*—Patrick M. Hogan; Arthur L. Plevy

[57] ABSTRACT

An automation system for assembling photocathodes into vacuum tube housings so as to produce vacuum tube assemblies. Photocathodes are loaded, cleaned and otherwise processed in a first evacuated chamber. Similarly, vacuum tube housings are loaded, cleaned and otherwise processed in a second evacuated chamber. The first and second chambers are selectively interconnected wherein the photocathodes from the first chamber are transferred into the second chamber by an automated transfer mechanism. Once in the second chamber, the photocathodes are joined to the vacuum tube houses in an automation process, creating the final product vacuum tube assemblies.

26 Claims, 3 Drawing Sheets

AUTOMATED SYSTEM AND METHOD FOR ASSEMBLING IMAGE INTENSIFIER TUBES

FIELD OF THE INVENTION

The present invention relates to an automated system for producing image intensifier tubes and more particularly to such systems that bake, outgas, evacuate and seal image intensifier tubes in a time and labor efficient manner.

BACKGROUND OF THE INVENTION

Image intensifier tubes are well known devices that multiply the amount of incident light received and produce an intensified image that can be more easily viewed. Image intensifier tubes are particularly useful in producing visible images from received infrared energy, thereby providing a means for clearly viewing an object at night or during otherwise low light conditions. As a result, devices that utilize image intensifier tubes have been used in a wide variety of industrial and military applications. For example, image intensifier tubes are commonly used for enhancing the night vision of pilots, for photographing astronomical bodies and for providing night vision to the visually handicapped such as persons suffering from retinitis pigmentosa (night blindness).

Image intensifier tubes are well known in the industry by names that are based on the generic generation from which their designs came into being. As a result, image intensifier tubes are typically identified by their generation number, which can be from the Generation 0 tube to the current Generation III (Gen. III) tube. Modern Gen. III image intensifier tubes typically include three main components, namely a photocathode, a phosphor screen (anode) and an electron amplifier such as microchannel plate. All three components are disposed within an evacuated housing thereby permitting electrons to flow from the photocathode to the phosphor screen across the electron amplifier. For examples of such devices reference is made to U.S. Pat. No. 5,029,963 entitled "Replacement Device for a Driver's Viewer" issued on Jul. 9, 1991 to C. Nancelli et al. and assigned to ITT Corporation the assignee herein. Both Gen. II and Gen. III image intensifiers are discussed in this reference.

In a Gen. III image intensifier tube the phosphor screen and electron amplifier components of the image intensifier tube are contained within a tube subassembly. The tube subassembly and photocathode are traditionally manufactured separately and are then assembled to create the overall image intensifier tube structure. Referring to FIG. 1, a typical Gen. III image intensifier tube 10 is shown, such as is currently manufactured by ITT Corporation, the assignee herein. As can be seen, both the tube subassembly 11 and the photocathode 25 are complex structures. The vacuum housing 12 that defines the exterior of the tube subassembly 11 is constructed by the juxtaposition of annular conductive elements and dielectric elements that are brazed together to create an air impervious structure. The lower end of the vacuum housing 12 is sealed by the presence of an screen flange 16 and a centrally positioned fiber optic element 18. The phosphor screen 20, against which electrons will eventually impinge, is disposed across the top surface 22 of the fiber optic element 18 so that the phosphor screen 20 faces the photocathode 25.

The tube subassembly 11 is manufactured in ambient pressure using traditional well-known manufacturing techniques. Similarly the body of the photocathode 25 is separately manufactured in ambient pressure also utilizing traditional well-known manufacturing techniques. When the photocathode 25 is assembled to the tube subassembly 11, the photocathode 25 seals the upper end of the tube subassembly 11, thereby isolating the interior of the image intensifier tube 10 between the photocathode 25 and the phosphor screen 20. Since a vacuum must be present within the image intensifier tube 10, the photocathode 25 must be assembled to the tube subassembly 11 in a clean, evacuated environment, thereby greatly increasing the complexity, time and cost of the overall manufacturing procedure. In the prior art, the assembly of the photocathodes 25 to the tube subassemblies 11 was traditionally done in a single evacuated chamber, two image intensifier tubes at a time. Due to the time involved in loading and unloading the evacuated chamber, evacuating the chamber, baking the chamber and waiting for parts to properly cool, the prior art assembly systems only produced about 2.5 tubes in a twenty-four hour period. Such a labor intensive and slow manufacturing process has added significantly to the cost of image intensifier tubes and has left the image intensifier tubes vulnerable to many potential manufacturing defects that effect the overall reliability of the image intensifier tubes.

It is therefore an objective of the present invention to produce an automated assembly system capable of assembling a high volume of image intensifier tubes in a labor and time efficient manner.

It is a further object of the present invention to provide an automated assembly system for image intensifier tubes that produces an image intensifier tube of a higher quality and reliability than is available from the prior art.

SUMMARY OF THE INVENTION

The present invention is an automated system and method for assembling photocathodes with vacuum tube housings. The present invention system includes a photocathode processing chamber capable of retaining an evacuated environment. Within the photocathode processing chamber is a means for heat cleaning the photocathodes and a means for creating a layer of cesium oxide on the photocathodes. Photocathodes are introduced into the photocathode processing chamber from an adjacent loading chamber via an automated transfer device. The automated transfer device transfers photocathodes from the adjacent loading chamber to receptacles adapted to receive the photocathodes within the photocathode processing chamber. The receptacles within the photocathode processing chamber are disposed upon a rotating platform, as such, the photocathodes can be rotatably moved between various stations within the photocathode processing chamber. A transfer arm engages each of the photocathodes held within the processing chamber. The transfer arm is used to lift each of the photocathodes out of its receptacle and place the photocathode in front of a heat lamp where the photocathode is heat cleaned or treated. The same transfer arm is also used to transfer the photocathodes from their receptacles to a processing station where the photocathodes are coated on one surface with cesium and are treated with oxygen.

Once each of the photocathodes within the photocathode processing chamber are heat cleaned and coated, a second automated transfer mechanism lifts each photocathode out of its receptacle in the photocathode processing chamber and places each photocathode into another receptacle within a tube assembly chamber. Prior to the addition of the photocathodes into the tube assembly chamber, vacuum tube housings are placed into the receptacles in the tube assembly chamber. As the photocathodes are placed into the tube assembly chamber, they are positioned within the various vacuum tube housings. The receptacles within the tube assembly chamber are also disposed upon a rotating platform. After all the photocathodes have been loaded, the receptacles are rotated to coact with a press mechanism. The press mechanism presses the photocathode into the vacuum tube housing creating an air tight seal between both components. After all the photocathodes have been sealed, the tube assembly chamber is vented to ambient pressure and the finished sealed vacuum tubes are removed.

BRIEF DESCRIPTION OF THE DRAWINGS

For a better understanding of the present invention, reference is made to the following description of an exemplary embodiment thereof, considered in conjunction with the accompanying drawings, in which.

DETAILED DESCRIPTION OF THE INVENTION

Although the present invention system can be used in manufacturing many different types of vacuum tubes, such as Gen. II image intensifier tubes, X-ray image intensifier tubes and the like, the present invention is especially suitable for use in manufacturing Gen. III image intensifier tubes. Accordingly, the present invention will be described in connection with the manufacturing procedure for a Gen. III image intensifier tube.

Figure 1:
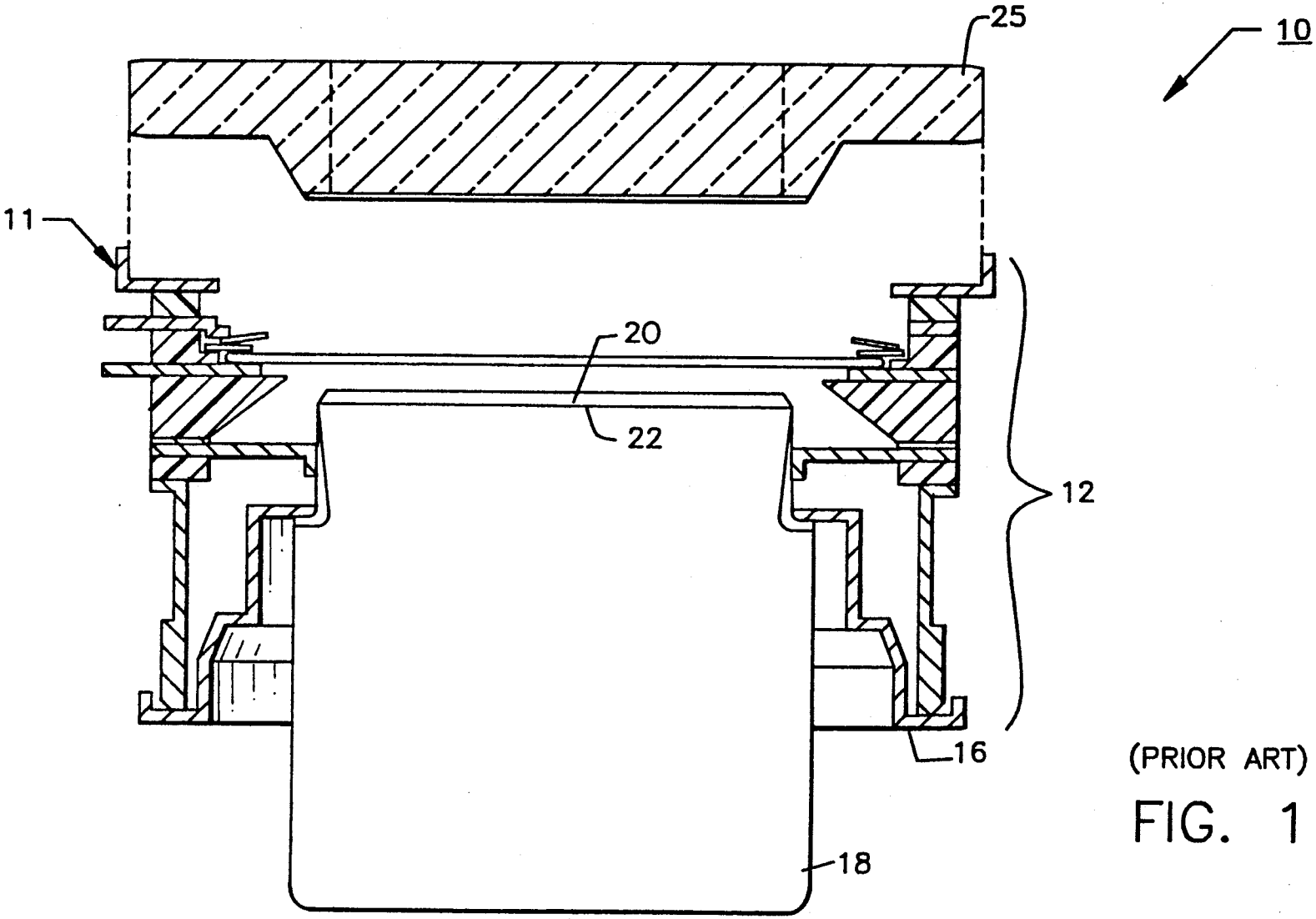
(PRIOR ART) FIG. 1
FIG. 1 is a cross-sectional view of a prior art Gen. III image intensifier tube to help illustrate the components assembled by the present invention assembly system and method.
Figure 2:
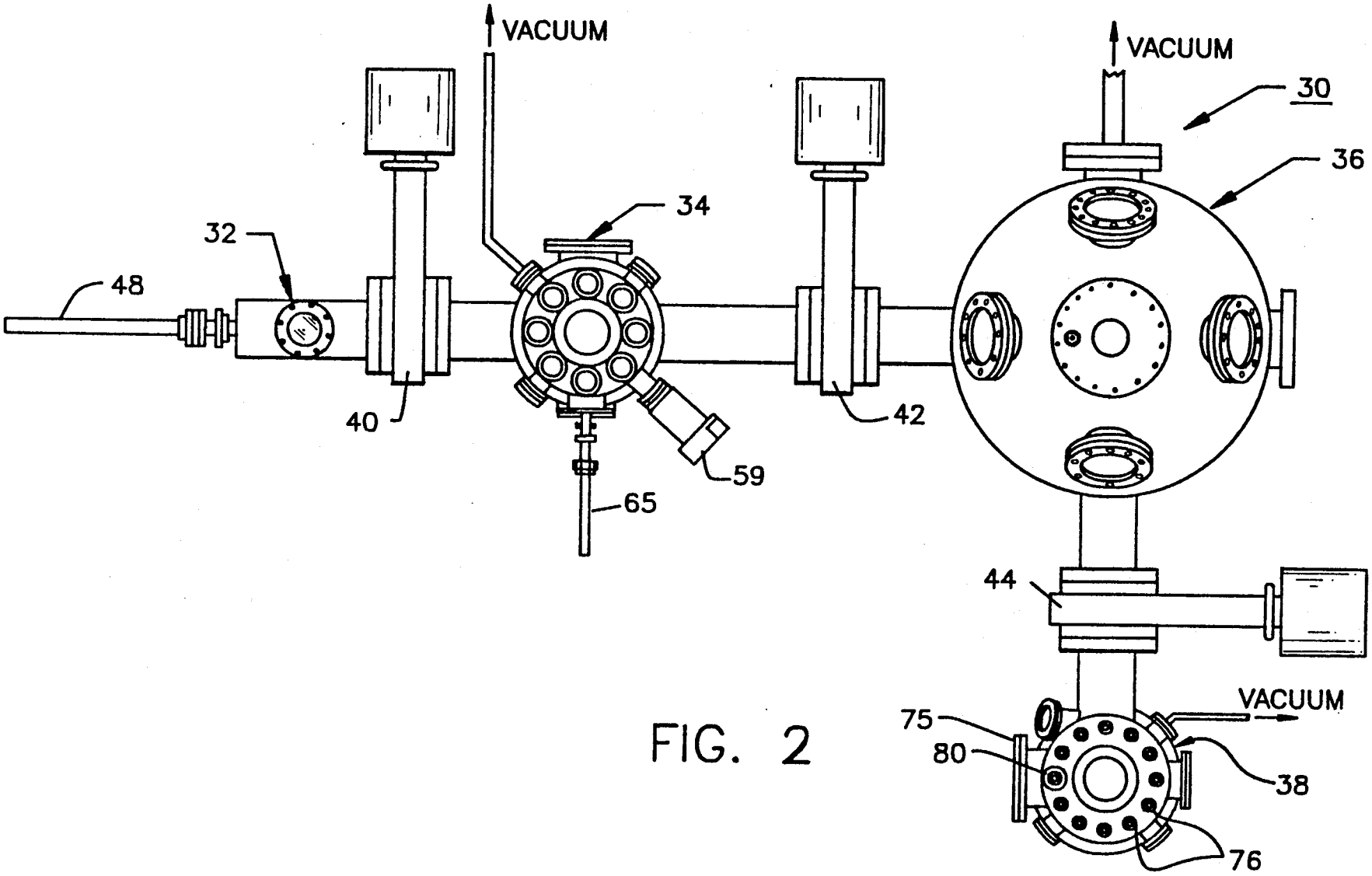
FIG. 2 is a top plan view of one preferred embodiment of the present invention automated assembly system.

Referring to FIG. 2, the present invention automated assembly system 30 is shown for assembling photocathodes onto tube subassemblies so as to create Gen. III image intensifier tubes. The automated assembly system 30 includes four separate processing stations, those stations being the photocathode loading station 32, the photocathode cleaning station 34, the transfer station 36 and the tube body assembly station 38. In the preferred embodiment, a first gate valve 40 separates the photocathode loading station 32 from the photocathode cleaning station 34. Similarly, a second gate valve 42 separates the photocathode cleaning station 34 from the transfer station 36 and a third gate valve 44 separates the transfer station 36 from the tube body assembly station 38. Each of the four chambers is a vacuum vessel capable of withstanding a vacuum of at least $10^{-10}$ millitorrs. The presence of the three gate valves 40, 42, 44 allows each of the four chambers to be selectively coupled or isolated from one another. Furthermore, the photocathode cleaning station 34, transfer station 36 and tube body assembly station 38 are each coupled independently to a vacuum source. Consequently, the photocathode cleaning station 34, transfer station 36 and tube body assembly station can be evacuated or vented either individually or joined as a common vessel.

Figure 3:
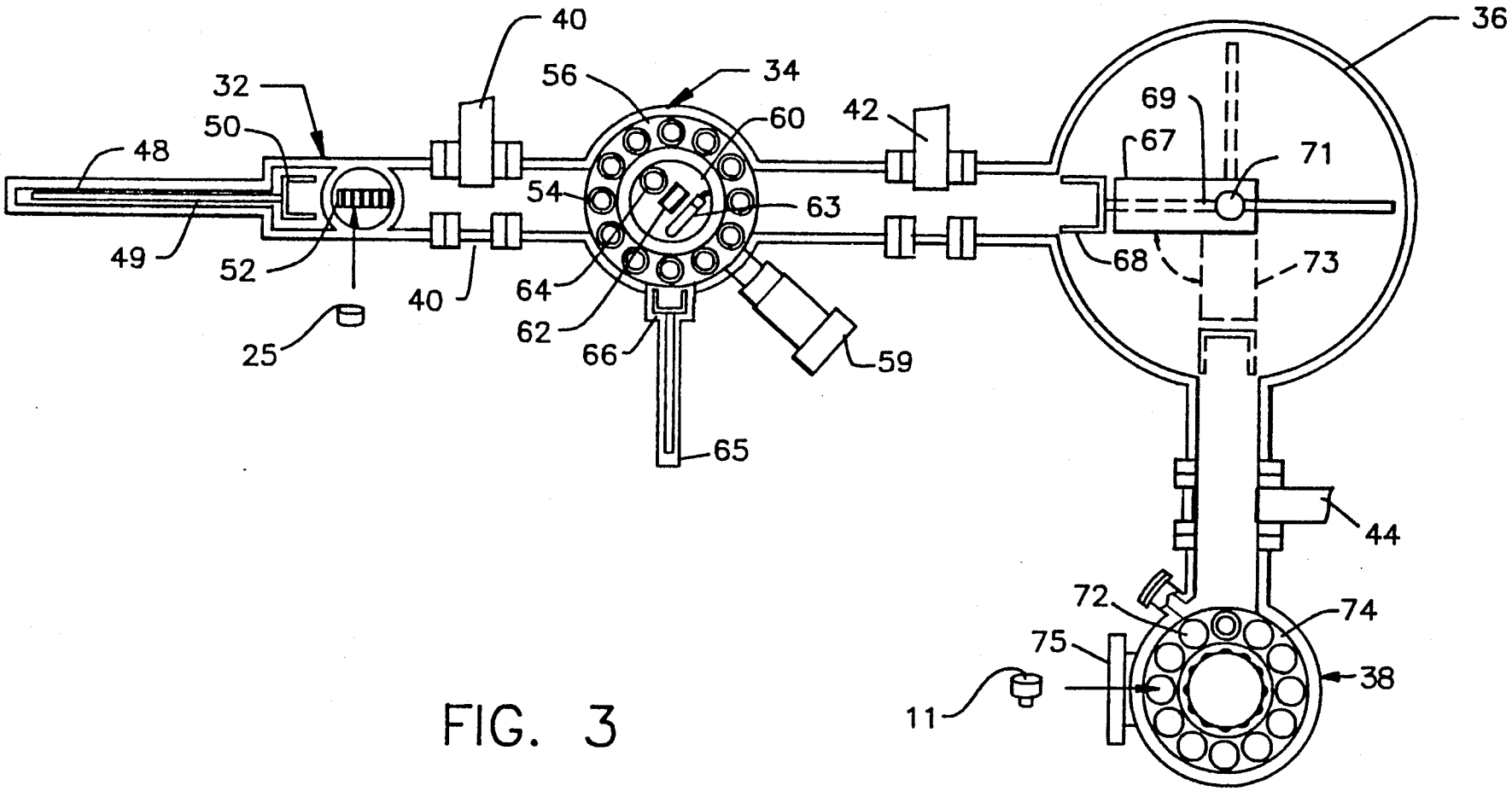
FIG. 3 is a top view of the embodiment of the assembly system shown in FIG. 2 having its upper regions removed to expose internal components and facilitate consideration and discussion.

Referring to FIG. 3, in conjunction with FIG. 2, it can be seen that an automated transfer mechanism 48 is positioned adjacent to the photocathode loading station 32. The automated transfer mechanism 48 includes a transfer arm 49 having a gripping device 50 at one end adapted to engage and manipulate photocathodes. In the shown embodiment, the transfer arm 49 is elongated and is capable when moved of extending across the loading station 32 and into photocathode cleaning station 34. The movement of the transfer arm 49 can be controlled through many well known prior art control mechanisms. It will be understood, however, that the automated transfer mechanism 48 need not be an elongated transfer arm but may be any known transfer device, such as robot arm, conveyor system or the like capable of repeatedly engaging photocathodes in the loading station 32 and moving those photocathodes into the photocathode cleaning station Photocathodes 25 are manually placed into the photocathode loading station 32 when the first gate value 40 is closed and the photocathode loading station 32 is vented to ambient pressure. The photocathodes 25 are placed in a stand 52 that positions the photocathode 25 into a set orientation. Once the photocathodes 25 have been loaded, the photocathode loading station 32 is sealed and the first gate valve 40 is opened, coupling the enclosure of the photocathode loading station 32 to the enclosure of the photocathode cleaning station 34. The automated transfer mechanism 48 manipulates the transfer arm 49 so that the gripping device 50 grasps a photocathode 25, lifts the photocathode 25 off the stand 52, transports the photocathode 25 past the first gate valve 40 and places the photocathode 25 into a receptacle 54 within the photocathode cleaning station 34. The movements provided by the automated transfer mechanism 48 are repeated until all of the photocathodes 25 loaded into the photocathode loading station 32 are transferred into the photocathode cleaning station 34. The repeated movements of the automated transfer mechanism 48 can be produced through microprocessor controlled motors, cam arrangements, gear assemblies or any other known actuation device.

The photocathode cleaning station 34 includes a rotating platform 56 upon which are positioned a plurality of receptacles 54. As the automated transfer mechanism 48 loads photocathodes into one of the receptacles 54 on the rotating platform 56, the rotating platform 56 rotates a predetermined, controlled amount effective to position an empty receptacle 54 toward the photocathode loading station 32. The stepped rotation of the rotating platform 56 continues until a separate photocathode 25 has been placed into each of the receptacles 54 or until there are no more photocathodes 25 left to be loaded. Vacuum chambers that include rotating platforms 56 are commercially available and are a commonly used piece of manufacturing equipment. Several models of such vacuum chambers are sold by Varian Inc. of Italy. Another example of a prior art rotating table that is used in the manufacturing of image intensifier tubes is shown in U.S. Pat. No. 5,178,546 to Dickerson, entitled CONTACT APPARATUS FOR COUPLING TERMINALS WHICH MOVE WITH RESPECT TO ONE ANOTHER issued on Jan. 12, 1993 and assigned to ITT Corporation, the assignee herein.

Although rotating platforms are commercially available, the adaptation of such a platform to a specific manufacturing application differs from product to product. In the present invention assembly system 10, the receptacles 54 in the photocathode cleaning station 34 are custom made to retain the photocathodes 25 in a set orientation on the rotating platform 56. In the shown photocathode cleaning station 34, the rotating platform 56 rotates around a stationary central hub region 60. Disposed on the central hub region 60 is a heat clean stand 62, a heat lamp 63 and a process well 64. The heat clean stand 62 and process well 64 are adapted to receive the photocathodes 25 and are therefore specially manufactured depending upon the physical dimensions of the photocathodes 25. Furthermore, the photocathode cleaning station 34 also includes a second transfer mechanism 65 above the rotating platform 56. The transfer mechanism 65 includes a custom gripping device 66 adapted to grasp and manipulate the photocathodes 25 within the receptacles 54. The transfer mechanism 65 is similar to the automated transfer mechanism 48 used to load the photocathode 25 into the photocathode cleaning station 34, however the transfer mechanism 65 may have a shorter arm since it does not have to move photocathodes across large distances. The transfer mechanism 65 may be any known transfer device adaptable for use in an evacuated chamber. Although such a device may be fully automated, in the most practical embodiment of the invention the transfer mechanism 65 is manually controlled. By using manual controls, the photocathodes 25 can be more consistently manipulated to and from the receptacles without error.

Once all the photocathodes 25 have been transferred from the photocathode loading station 32 to the photocathode cleaning station 34, the first gate valve 40 is closed, isolating the photocathode cleaning station 34 from the photocathode loading station 32. The photocathode cleaning station is then evacuated. Once evacuated, the transfer mechanism 65 lifts a photocathode 25 from a receptacle 54 on the rotating platform 56 and places that photocathode 25 in the heat clean stand 62 adjacent to the heat lamp 63. The heat lamp 63 is activated and operates to heat clean the photocathode in the stand 62. The temperature of each photocathode 24 during the heat cleaning step is monitored by a camera 59 that is directed toward the heat clean stand 62 and monitors the radiant energy emanating from the photocathode being heated on the heat clean stand 62. After a predetermined period of heat cleaning, the transfer mechanism 65 returns the heat cleaned photocathode to its receptacle 54 on the rotating platform 56. The rotating platform 56 then rotates to the next position and the transfer mechanism 65 transfers the next subsequent photocathode to the heat clean stand 62 for the heat cleaning. The process is continued until all the photocathodes 25 have been heat cleaned. At the termination of the heat cleaning operation for the last photocathode, all the photocathodes 25 are allowed to cool over a predetermined cool-down period.

Once cooled, the automatic transfer mechanism 65 is again used to lift each photocathode 25 out of its receptacle 54 and place it within the process well 64. Preferably, the order that the photocathodes were heat cleaned is same order used in transferring the photocathodes to the process well 64. When photocathode is moved to the process well 64 the photocathode is held over a deposition channel (not shown). The deposition channel can be any known structure through which a material can be deposited onto a surface of the photocathode utilizing vapor deposition. In the shown embodiment, cesium is administered through the channel onto the photocathode. Once the cesium is deposited, oxygen is emitted against the cesium. The oxygen reacts with the cesium creating the desired cesium oxide layer on the photocathode. Excess cesium and oxygen are removed from the photocathode cleaning station 34 by the vacuum source coupled to the photocathode cleaning station 34. After the photocathode has been processed with the cesium and oxygen, the transfer mechanism 65 returns the photocathode to its receptacle 54 on the rotating platform 56. The rotating platform 56 is stepped and the next subsequent photocathode is transferred to the process well 64. This cycle is repeated until all the photocathodes 25 have been processed.

Once the photocathodes 25 have been heat cleaned and processed, the second gate valve 42 is opened interconnecting the transfer station 36 to the photocathode cleaning station 34. Prior to the opening of the second gate valve 42, the environment of the transfer station 36 is evacuated and baked clean. This is necessary so as to not contaminate the cleaned photocathodes arriving from the photocathode cleaning station 34. A transfer arm 67 is disposed within the transfer station 36. The transfer arm 67 has a grip 68 disposed at the end of an elongated shaft 69, wherein the shaft 69 and grip 68 are capable when moved of extending into the photocathode cleaning station 34, lifting a photocathode 25 out of its receptacle 54 on the rotating platform 56 and returning the photocathode into the transfer station 36. Once retrieved into the transfer station 36, the transfer arm 67 rotates about its central point 71 and aligns the held photocathode with the opening obstructed by the third gate valve 44, as is shown by hidden line arm 73.

The third gate valve 44 connects the transfer station 36 to the tube body assembly station 38. Before the third gate valve 44 is opened, the tube body assembly station 38 is evacuated and baked clean so as not to contaminate the clean incoming photocathodes. After the third gate valve 44 is opened, the transfer arm 67 extends into the tube body assemble station 38 and places the grasped photocathode into a receptacle 72 within tube body assemble station 38. The transfer arm 67 then returns to the photocathode cleaning station 34, picks up the next subsequent photocathode, places it into receptacle 72 in the tube body assembly station 38 and repeats the cycle.

Transfer stations capable of transferring objects from one evacuated chamber to another are known in the art. Such transfer stations are exemplified by the rotary multiport distribution vessel, model R2P2 currently being manufactured by the Kurt J. Lesker Company of Philadelphia, Pa.

The tube body assembly station 38 includes a rotary platform 74 similar to that provided in the photocathode cleaning station 34. Receptacles 72 are positioned at points along the rotating platform 74. As will be explained, the receptacles 72 are adapted to receive and hold completed image intensifier tube assemblies. Prior to the third gate valve 44 being opened between the transfer station 36 and the tube body assembly station 38, tube subassemblies 11 are placed into the receptacles 72 on the rotating platform 74. The tube subassemblies 11 can be placed into the tube body assembly station 38 by an automated machine or may be manually placed into the receptacles 72 through the window port 75. Once a tube subassembly 11 is placed in each receptacle 72 on the rotating platform 74, the window port 75 is closed and the tube body assembly station 38 is evacuated and baked clean. The baking of the tube body assembly station 38 cleans contaminants both from the tube body assembly station 38 itself and the tube subassemblies 11 held within the tube body assembly station 38. After the tube body assembly station 38 is baked, the tube body assembly station 38 and the tube subassemblies 11 it contains are allowed to cool for a predetermined period.

Electron floodguns 76 (shown from above in FIG. 2) are disposed above each of the receptacles 72 within the tube body assembly station 38. Consequently, an electron floodgun 76 is disposed above each of the tube subassemblies 11 held within the receptacles 72. After the tube body assembly station 38 and the tube subassemblies 11 are baked and cooled, the electron floodguns 76 are activated and the electron floodguns 76 bombard each of the tube subassemblies 11 with an electron beam, thereby scrubbing the tube subassemblies 11 and outgassing the components of each tube subassembly. After a predetermined scrub period, the electron floodguns 76 are disabled and the getters contained within each tube subassembly 11 are flashed.

Once the tube assemblies 11 have been baked, scrubbed and their getters flashed the third gate valve 40 is opened, interconnecting the transfer station 36 to the tube body assembly station 38. The transfer arm 67, within the transfer station 36, then proceeds to retrieve photocathodes 25 from the photocathode cleaning station 34 and place those photocathodes 25 into the tube body assembly station 38. The photocathodes 25 are moved by the transfer arm 67 one at a time. As the transfer arm 67 transfers a photocathode 25 into the tube body assembly station 38, the transfer arm 67 places the photocathode 25 into a receptacle 72 on the rotating platform 74 directly upon the tube subassembly 11 already in that position. Once a photocathode 25 is properly positioned by the transfer arm 67, the transfer arm 67 retreats to retrieve the next subsequent photocathode from the photocathode cleaning station 34 and the rotating platform 74 of the tube body assembly station 38 rotates to ready the next subsequent receptacle 72 for the next photocathode.

Once a photocathode 25 has been placed atop each of the tube assemblies 11 in the tube body assembly station 38, the second gate valve 42 and third gate valve 44 are closed. With the gate valves closed, the photocathode cleaning station 34 is now ready to receive and process a new set of photocathodes from the photocathode loading station 34.

A press mechanism 80 (shown from above in FIG. 2) is disposed above the rotating platform 74 of the tube body assembly station 38 at one set position. The rotating platform 74 rotates in a stepped fashion, positioning each of the receptacles 72 under the press mechanism 80 for a short duration of time. When a receptacle 72 is positioned under the press mechanism 80, the ram of the press mechanism 80 descends and engages the photocathode 25 that is disposed atop the tube subassembly 11. The press mechanism presses the photocathode 25 into the tube subassembly 11 wherein an airtight cold indium seal is created between the photocathode 25 and the tube subassembly 11. The press mechanism 80 then retreats, the rotating platform 74 rotates and the process is repeated until all the photocathodes 25 are sealed to the tube subassemblies 11.

After all the tubes are sealed, the tube body assembly station 38 is vented and the finished image intensifier tubes removed. In the shown embodiment, a single photocathode cleaning station 34 is coupled to a tube body assembly station 38 via the transfer station 36. It will be understood, however, that multiple photocathode cleaning stations can be coupled to a single tube body assembly station to increase production volume. Additionally, in the present invention automated assembly system 30, the manufacturing processes conducted within the photocathode cleaning station are independent of the manufacturing processes being conducted within the tube body assembly station. As such, both stations once loaded, can be run independently of each other and simultaneously in order to improve production volume and efficiency.

As an optional step, the photocathode cleaning station 34 may be baked clean before each new batch of photocathodes is loaded into the photocathode cleaning station. As a result, any cesium build up from the processing of the photocathodes can be removed from the photocathode cleaning station after each batch of photocathodes are processed.

It will be understood that the embodiment described herein is merely exemplary and that a person skilled in the art may make many variations and modifications to the described embodiments utilizing functionally equivalent elements and mechanisms to those described. More specifically, it will be understood that the various vacuum chambers may arranged in any orientation and may include additional process stations to those described. All such variations and modifications are intended to be included within the scope of this invention as defined by the appended claims.

What is claimed is:

1. An automated system for assembling photocathodes into vacuum tube housings, comprising:

a first chamber capable of retaining an evacuated environment;

means for introducing at least one photocathode into said first chamber;

heat cleaning means disposed within said first chamber, for heat cleaning said at least one photocathode;

a second chamber coupled to said first chamber, wherein said second chamber is capable of retaining an evacuated environment;

means for isolating the environment of said first chamber from the environment of said tube assembly chamber;

means for introducing at least one vacuum tube housing into said second chamber;

automated transfer means for transferring said at least one photocathode from said first chamber to said second chamber wherein each photocathode is placed on a vacuum tube housing; and a sealing device disposed within said second chamber wherein said sealing device seals said photocathode within said vacuum tube housing.

2. The system according to claim 1, wherein said first chamber and said second chamber are each independently coupled to a vacuum source.

3. The system according to claim 1, further including a means for monitoring the temperature of said at least one photocathode as said at least one photocathode is heat cleaned by said heat cleaning means.

4. The system according to claim 1, further including deposition means disposed within said first chamber for depositing a material onto a surface of said at least one photocathode.

5. The system according to claim 4, further including a means for exposing the material deposited onto the photocathode to oxygen.

6. The system according to claim 1, wherein said heat cleaning means includes a heating element and a support stand for retaining a photocathode in a set position relative said heating element.

7. The system according to claim 6, wherein said first chamber includes a plurality of receptacles disposed on a rotating platform, wherein said means for introducing at least one photocathode into said first chamber places a photocathode in each of said receptacles.

8. The system according to claim 7, further including an automated means for transferring each photocathode from each receptacle to said support stand and returning the photocathode to the receptacle from said support stand.

9. The system according to claim 1, wherein said second chamber includes a plurality of receptacles disposed on a rotating platform, wherein said means for introducing at least one vacuum tube housing into said tube assembly chamber places a vacuum tube housing into each of said receptacles.

10. The system according to claim 9, wherein said automated transfer means transfers each photocathode from said first chamber and places each photocathode upon a vacuum tube housing in said second chamber.

11. The system according to claim 10, wherein said sealing device includes a press that presses each photocathode into each vacuum tube housing creating an air impervious seal between the photocathode and the vacuum tube housing.

12. The system according to claim 1, further including a loading chamber, coupled to said first chamber, wherein said loading chamber is capable of retaining an evacuated environment.

13. The system according to claim 12, wherein said means for introducing at least one photocathode into said first chamber transfers said at least one photocathode from said loading chamber to said first chamber.

14. The system according to claim 13, further including a means for isolating the environment of said loading chamber from the environment of said second chamber.

15. The system according to claim 1, further including a cleaning means disposed within said second chamber for cleaning said at least one vacuum tube in said second chamber.

16. The system according to claim 15, wherein said cleaning means including at least one electron gun disposed above said at least one vacuum tube in said second chamber, wherein each said electron gun bombards said at least one vacuum tube.

17. A method of assembling photocathodes into vacuum tube housings, comprising the steps of:

loading at least one photocathode into a first chamber;

loading at least one vacuum tube housing into a second chamber;

evacuating said first chamber and said second chamber;

processing said at least one photocathode within said first chamber and said at least one vacuum tube housing within said second chamber;

interconnecting said first chamber to said second chamber by selectively opening at least one valve disposed between said first chamber and said second chamber;

transferring said at least one photocathode from said first chamber to said second chamber; and assembling said at least one photocathode to said at least one vacuum tube housing in said second chamber forming at least one vacuum tube assembly.

18. The method according to claim 17, wherein said step of processing said at least one photocathode includes exposing said at least one photocathode to a heat lamp.

19. The method according to claim 17, wherein said step of processing said at least one vacuum tube housing includes exposing said at least one vacuum tube housing to an electron beam.

20. The method according to claim 17, wherein said step of assembling said at least one photocathode to said at least one vacuum tube housing includes pressing a photocathode into a vacuum tube housing forming an air tight seal.

21. The method according to claim 17, wherein said step of transferring said at least one photocathode from said first chamber to said second chamber includes providing an automated transfer mechanism between said first chamber and said second chamber wherein said automated transfer mechanism engages said at least one photocathode in said first chamber, transfers said at least one photocathode to said second chamber and deposits said at least one photocathode in said second chamber at a set position.

22. The method according to claim 17, further including the step of baking said first chamber to remove contaminants from said first chamber.

23. The method according to claim 17, further including the step baking said second chamber to remove contaminants from said second chamber and said at least one vacuum tube housing disposed within said second chamber.

24. The method according to claim 17, wherein said step of loading at least one photocathode into a first chamber includes:

positioning said at least one photocathode in a loading station;

isolating the environment of said loading station;

interconnecting said loading station to said first chamber;

transferring said at least one photocathode from said loading station to first chamber utilizing automation transfer mechanism; and isolating the environment of said first chamber from said loading station.

25. The method according to claim 17, further including coating a surface of said at least one photocathode with a deposition material in said first chamber.

26. The method according to claim 25, further including exposing said deposition material to a reactive gas in said first chamber.

* * * * *